US006957970B2

(12) United States Patent
Weigel et al.

(10) Patent No.: US 6,957,970 B2
(45) Date of Patent: Oct. 25, 2005

(54) CONNECTOR FOR A CABLE FOR UNDERGROUND MINING

(75) Inventors: Wilfried Weigel, Werne (DE); Reiner Frank, Gevelsberg (DE)

(73) Assignee: DBT Automation GmbH, Lunen (DE)

( * ) Notice: Subject to any disclaimer, the term of this patent is extended or adjusted under 35 U.S.C. 154(b) by 0 days.

(21) Appl. No.: 10/225,002

(22) Filed: Aug. 21, 2002

(65) Prior Publication Data

US 2004/0038578 A1 Feb. 26, 2004

(30) Foreign Application Priority Data

Aug. 22, 2001 (DE) ..... 101 41 052

(51) Int. Cl.[7] ..... H01R 13/58; H01R 13/62

(52) U.S. Cl. ..... 439/320; 439/277; 439/455; 439/457; 439/460; 439/604; 439/610

(58) Field of Search ..... 439/271, 455, 439/460, 277, 320, 323, 604, 606, 610, 457, 468

(56) References Cited

U.S. PATENT DOCUMENTS 3,022,482 A * 2/1962 Waterfield et al. ..... 439/322
3,742,427 A * 6/1973 Ballard ..... 439/188
5,181,860 A * 1/1993 Honma et al. ..... 439/321
5,823,803 A * 10/1998 Majors ..... 439/98
6,375,493 B1 * 4/2002 Lin ..... 439/457

FOREIGN PATENT DOCUMENTS

| | | |
|---|---|---|
| DE | 1108767 | 6/1961 |
| DE | 2 200 396 | 7/1972 |
| DE | 297 00 897 U1 | 6/1998 |
| DE | 299 10 960 U1 | 12/1999 |
| DE | 200 04 566 U1 | 7/2000 |

* cited by examiner

*Primary Examiner*—Neil Abrams
(74) *Attorney, Agent, or Firm*—Cook, Alex, McFarron, Manzo, Cummings & Mehler, Ltd.

(57) ABSTRACT

The invention relates to a connector for a cable for underground mining, comprising a socket part 1 and a plug part axially insertable into the socket part and having a hole in the back for inserting a cable, the plug part being secured to the socket part 1 by a screw cap 20 mounted for rotation on the plug part 10 and screwable on to an external thread 6 on the socket part 1 and being sealed against penetration of moisture and/or dirt by at least one sealing element. In order to obtain standard parts for a family of plugs by a simple assembly process and with maximum sealing-tightness against moisture and dirt and at low production costs, the plugs being suitable for inserting the cable either coaxially or radially, the external thread 6 on the socket part 1 and the associated internal thread 21 on the screw cap 20 are triple threads and/or a crown part 40 with at least one radial recess 41 for receiving the cable 30 is provided on the cable entry hole 18 on the back of the plug part. (FIG. 1)

11 Claims, 2 Drawing Sheets

CONNECTOR FOR A CABLE FOR UNDERGROUND MINING

The present invention relates to a connector for a cable for underground mining, comprising a socket part and a plug part axially insertable into the socket part and having a hole in the back for inserting a cable, the plug part being secured to the socket part by a screw cap mounted for rotation on the plug part and screwable on to a thread on the socket part and being sealed against penetration of moisture and/or dirt by at least one sealing element.

Connectors of this construction are used in underground mining, especially for producing the electric cable connections between the individual units of electro-hydraulic support control systems. In order to avoid disturbances to operation and protect the electric contacts in the connectors from dirt, especially moisture, under the rough operating conditions underground, at least one sealing element is provided and screens the internal contacts from the environment when the plug part and the socket parts are in the assembled state. In DE 200 04 566 U1, from which the preamble is taken, two sealing elements in the form of O-rings are disposed in peripheral retaining grooves on the guide pin of the plug part at a distance from the rear retaining flange of the screw cap, which is axially lockable and mounted for free rotation, the sealing elements abutting the inner periphery of the socket part when in the assembled state. The electric cable is secured in the cable entry hole by an injection moulded part made of permanently elastic material and adapted to prevent moisture entering via the back of the plug part. The cable cores are connected to a connector disposed in the plug part and co-operating with a mating member in the socket part. A centring recess in the guide pin of the plug part and a centring pin in the socket part ensure that the socket part and the plug part and/or the associated connectors can be connected only in one position. This ensures that only the desired electric connection can be made by means of the connector. The cable is inserted into the entry hole in the plug part, coaxially with the guide pin of the plug part. A different connector design has hitherto been used for a radially inserted cable.

The aim of the present invention is to improve the socket part and the plug part so as to obtain standard parts for a family of plugs by a simple assembly process and with maximum sealing-tightness against entry of moisture and dirt, the plugs enabling the cable to be inserted either coaxially or radially.

Accordingly the present invention is directed to a connector as described in the opening paragraph of the present specification, in which the external thread on the socket part and the associated internal thread on the screw cap are multiple threads and/or a crown part with at least one radial recess for receiving the cable is provided on the cable entry hole on the back of the plug part. By means of the multiple thread, which is screwed on to the socket part and secures the screw cap thereto, the connector can be assembled after only one and a quarter or one and a half rotations of the screw cap, thus greatly simplifying assembly of the connector when used underground. The plug part is made suitable as a standard part for a family of plugs by the crown part on the back, which enables the cable to be inserted either coaxially or radially, and the receiving recess prevents the cable for the injection moulded part accidentally coming loose from the plug part.

In a preferred embodiment, the crown part has a number of receiving recesses offset from one another by 90° and/or open at the edge, by means of which the electric cable can be radially inserted in the cable entry hole from four different directions while simultaneously securing the cable in the recess. To this end the recesses can especially be three-quarter radial bores. Advantageously the crown part and the plug part are in one piece and preferably in the form of a turned metal part, especially a turned brass part. An especially firm connection between the cable and the plug part is obtained if, when inserted radially, the cable is fixed in one of the recesses by a clamping sleeve, the sleeve preferably being connected to the armour or sheath of the cable or clamped between the sleeve and the recess, so that tensile forces and leakage currents or the like can be reliably dissipated via the plug part. Another advantage of the recesses in the crown part is that a screen for increasing the electromagnetic shielding of the plug part can be clamped or placed on the recesses and/or radially aligned or extending sleeves can be disposed in the recesses and, when the cable is inserted coaxially, can provide additional mechanical reinforcement against tensile forces exerted on the cable.

For use in underground mining, in known manner, a permanently elastic injection-moulding part which fills the cable entry hole and the crown part and surrounds the cable and crown part is integrally formed on the plug part. For optimum sealing against entry of dirt and moisture, the wall portion of the plug part bounding the cable entry hole can be provided with a slot for receiving a sealing ring for additional sealing at the boundary surface between the metal plug part and the injection-moulded material filling the cable entry hole.

In the preferred embodiment of the connector according to the invention, the external thread on the socket part and the internal thread on the plug part are triple threads. The screw cap can be inexpensively mounted in simple manner on the plug part, preferably by means of a locking edge ring or the like, which on one side engages in a receiving groove in the guide pin of the plug part and on the other side engages in a peripheral receiving groove on the internal periphery of the screw cap. A gap sufficiently large to provide a free-running space or protect the cap from over-screwing can be provided between the internal thread of the screw cap and the internal thread of the said cap, so that the plug part and the socket part can be connected by a defined force during assembly and dismantling. Alternatively the gap can be substantially omitted apart from a relief groove necessitated by the manufacturing process, in which case the annular web will form an abutment for fixing the socket part and the plug part in the assembled state. This can be specially advantageous if, in the assembled state, a sealing ring, preferably an O-ring, is disposed between the end face of the screw cap and an abutment flange for the screw cap on the socket part, the ring preferably being disposed in a groove extending between the external thread and the abutment surface of the socket part. These steps prevent excessive compression of the O-ring. The sealing ring also prevents the metal screw cap from jamming against the socket part and counteracts corrosion between the said parts, thus making it more difficult for the connector to come loose. In the case of a space for free-running, the O-ring can apply axial force for re-inserting the thread, and can thus facilitate dismantling.

Examples of connectors made in accordance with the present invention will now be described in relation to the accompanying drawings, in which.

Figures 1, 2, 5:
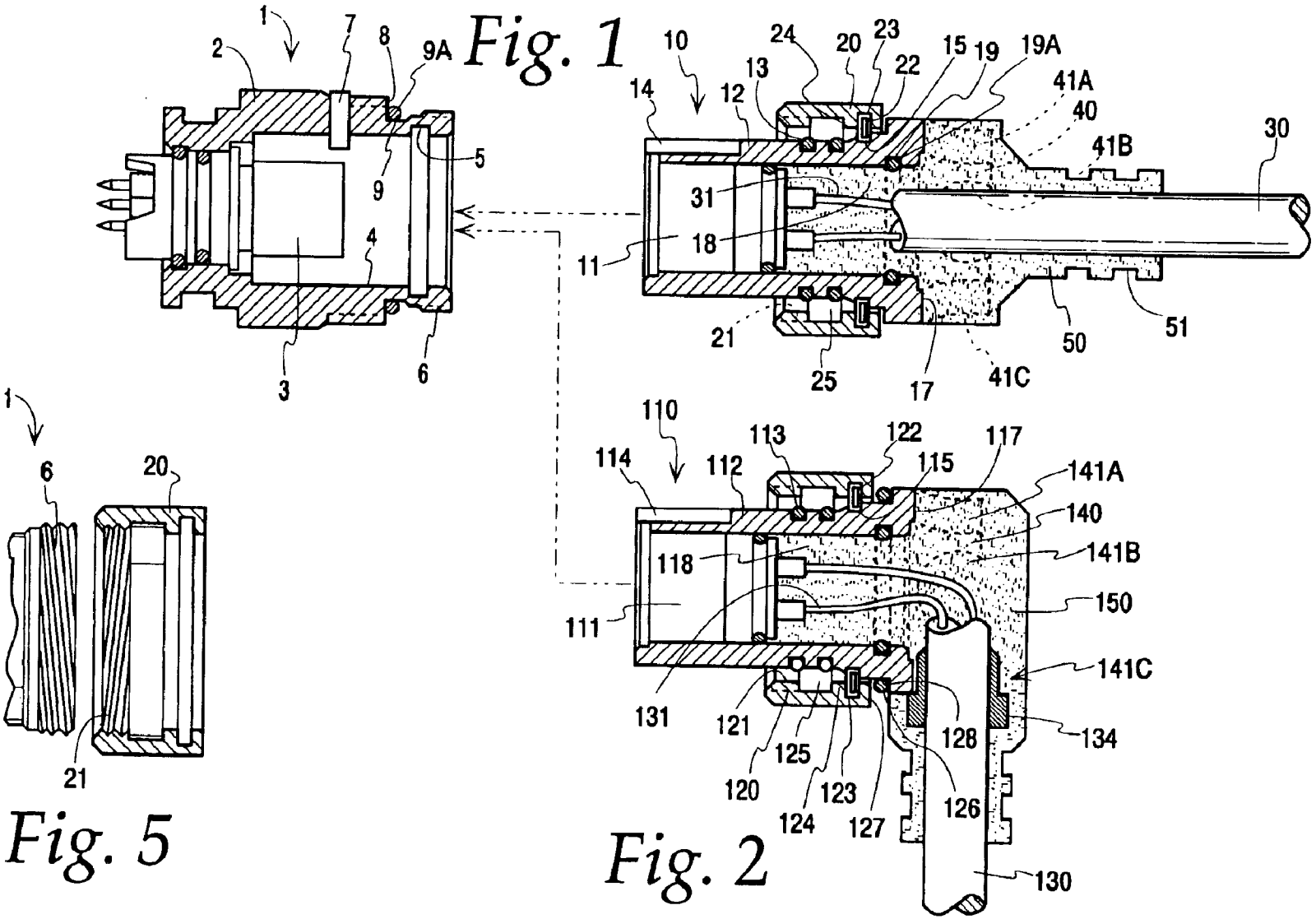
FIG. 1 is a sectional view of a connector comprising a socket part and a plug part, in a first embodiment in which the cable is inserted coaxially.
FIG. 2 is a sectional view of a connector comprising a plug part according to a second embodiment, with a radial cable entry.
FIG. 5 is an enlarged, partial exploded view of the socket part and plug part of FIG. 1.

FIG. 1 shows a first embodiment of a plug part 10 which can be plugged to a socket part 1 to form a connector. The socket part 1 has a brass socket component 2 containing a connector 3 which constitutes the mating part for a connector 11 in the plug part 10 when in the assembled state. At least one peripheral locking groove 5 is formed on the inner periphery 4 of the socket part 2 and, when assembled, lies in the same axial position as a front sealing and retaining ring 13 mounted on the cylindrical guide pin 12 of the plug part 10. The connectors 3, 11 are positioned relative to one another by a centring pin 7 which projects into the interior 6 of the socket part 1 and, during insertion of the plug part 10, cooperates with a centring groove 14 in the top of the guide pin 12. The socket part 2, at the open end for inserting the guide pin 12 of the plug part 10, has a multiple, preferably triple, external thread 6. An O-ring 9A is disposed in an associated groove 9 between the external thread 6 and a rear abutment flange 8 pointing towards the plug part 10.

The plug part 10 shown in FIG. 1 is secured to the socket part 1 by a screw cap 20 which to this end is mounted for free rotation on the plug part 10 and has a triple internal thread 21 at its front end. The screw cap 20 is rotatably mounted and axially secured on the guide pin 12 of the plug part 10 by a securing ring or locking edge ring 22 having an internal annular surface which rests in a narrow receiving groove 15 in the guide pin 12 and an external annular surface which engages in a groove 23 on the inner periphery of the cap 20. The annular web 24 opposite the internal thread on the screw cap 20 is separated from the internal thread 21 by a gap 25 which, in the example embodiment in FIG. 1, permits free running and prevents over-screwing of the cap when in the assembled state (not shown), since the gap 25 is greater than the axial length of the external thread 6. Owing to the co-operation between the triple internal thread 21 on the cap 20 and the triple external thread 6 on the socket component 2, the plug part 10 and the socket part 1 are secured after only 1.25 to 1.5 turns of the cap 20. In the assembled state, i.e. when the cap 20 is screwed on, the O-ring 9A on the socket part is clamped between the cap and the abutment flange 8, so as to give additional protection against entry of moisture and prevent corrosion between the screw cap 20 and the socket component 2, and also exerting axial force on the screw cap 20, thus enabling the internal thread 21 to be re-inserted into the multiple thread 6 on the socket part 2 when dismantled. In the example embodiment in FIG. 1 the socket part 10 has a second rear O-ring 16 which, as described in DE 200 04 566 U1, lies between the socket part 2 and the guide pin 12 and seals against entry of moisture and dirt.

The cable 30, coaxially with the guide pin 12, is inserted from the back 17 of the plug part 10 into the cable entry hole 18 of the said part 10. The cores 31 of the cable 30 are connected to the connector 11 in the plug part 10. A crown part 40 is integrally formed on the back 17 of the plug part 10 and has four radial receiving recesses 41A, 41B, 41C offset from one another by 90° open at the edge and in the form of three-quarter radial bores. In FIG. 1 the cable 30, when coaxially inserted, is supplied through a central recess in the crown part 40 without being connected thereto in tension-resistant or non-rotatable manner. The cable entry hole 18, the cores 31, the cable 30 and the crown part 40 are embedded in an injection-moulded part 50 made of permanently elastic material which is formed on the plug part 2 in an injection mould (not shown) at the end of the assembly process and has a flexi-constriction 51. The casting operation secures the cable 30 axially and in non-rotatable manner, and owing to the recesses the moulded part 50 is also positively secured to the metal plug part 10. As an additional barrier against entry of moisture between the brass plug part 10 and the injection-moulded part 50, a groove 19 for optionally inserting an O-ring 19A or the like is provided in the inner wall of the cable entry hole 18.

FIG. 2 shows a plug part 110 according to a second embodiment, inserted into the previously-described socket part 1 and adapted to be secured to the multiple external thread 6 by the screw cap 120 and the internal thread 121 therein. As before, the cap 120 is axially secured and rotatably mounted on the plug part 110 by means of a locking edge ring 122 which engages in a groove 115 in the guide pin 112 and a groove 123 on the inner periphery of the screw cap 120. Only a short relief groove 125 is provided between the multiple internal thread 121 and the facing annular web 124, so that when the cap 120 has been screwed on to the triple external thread 6 of the socket part 2, the annular web 124 forms a fixing abutment on the socket part 1. In the assembled state the O-ring 9A on the socket part 1 is clamped between the screw cap 120 and the abutment flange 8, so that it provides additional protection against entry of moisture and prevents corrosion between the screw cap 120 and the socket part 2. The guide pin 112 is formed with only a single groove for receiving a sealing ring 113, which in the assembled state engages in the locking groove 5 and axially secures the plug part 110 in the socket part 2. An additional sealing ring 126 is disposed between the back 127 of the cap 120 and an abutment flange 128 on the plug part 110 and prevents any moisture or dirt from penetrating in to the space between the cap 120 and the plug part 110. In the case of the plug part 110, also, of course, the guide pin can have two O-rings and/or the screw cap in FIG. 1 can be inserted.

As in the example embodiment in FIG. 2, the plug part 110 at the back 117 has a crown part 140 with four radial receiving recesses 141A, 141B, 141C open at the edge and in the form of three-quarter bores, Wherein the cable 130, supplied from the side in this case, is inserted together with a clamping sleeve 134 into the recess 141C. In spite of the lateral, bent feed, the cable 130 is fixed to the plug part 110 and protected from tensile and bending forces. After the ends 131 of the cable have been connected to the connector 111, an injection-moulded part 150 of permanently elastic material is integrally formed and completely fills or embeds the cable 130, the clamping sleeve 134, the crown part 140 and the cable entry hole 118, so that in spite of the rough conditions underground, moisture and dirt cannot penetrate from the back of the plug part 110 into the connector. The cable armour or the cable sheath can be clamped between the clamping sleeve 134 and the outside of the cable 130 so as to provide good electromagnetic screening, transmit leakage currents to the plug part 110, and enable tensile forces exerted on the cable to be absorbed in the plug part.

Figure 3:
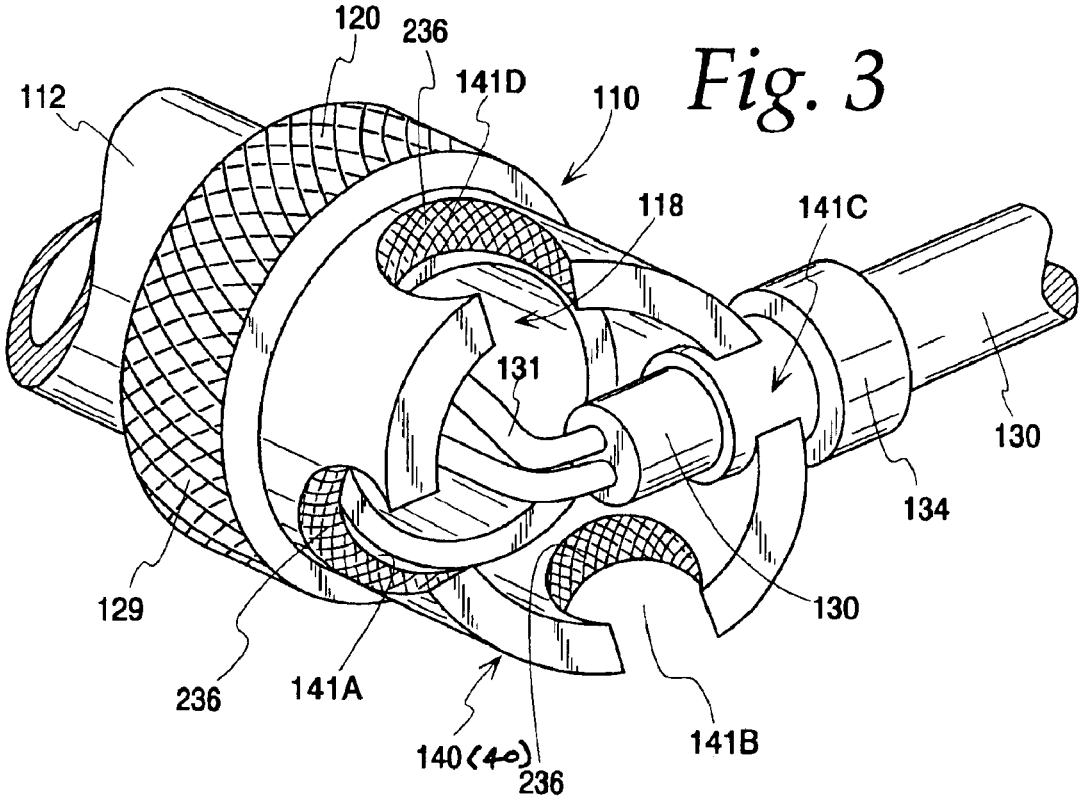
FIG. 3 is a perspective view of the crown part of the plug part in FIG. 2 before the injection-moulded part has been integrally formed.

The construction of the crown part 140 on the back of the plug part 120 is shown especially clearly in FIG. 3, in which an injection-moulded part has not yet been integrally formed. FIG. 3 shows a fourth recess 141D in addition to the recesses 141A, 141B, 141C. Since the recesses 141A–D are all three-quarter bores, they firmly secure the clamping sleeve 134 and cable 130 to the plug part 110. The clamping sleeve 134 slid on to the jacket of the cable 130 can be inserted and, if required, locked in the recess 141C from the side only. The crown part 140 formed with the recesses 141A–D constitutes an annular or sleeve-like axial prolongation of the plug part. The screw cap 120 is externally milled at 129.

Figure 4:
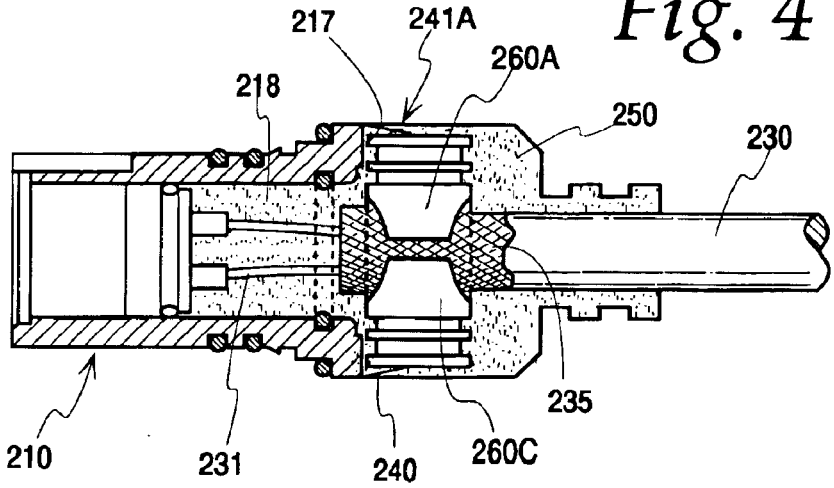
FIG. 4 is a sectional view of a plug part according to FIG. 2 with an axially inserted cable and a screen.

FIG. 4 shows a fourth example embodiment in which the plug part 210 has the same construction as the plug part 110. There are differences in the manner of supplying the cable 230, in the design of the moulded part 250 and in the sleeves 260A and 260C, which are inserted into the recesses 241A, 241C in the crown part 240 and project radially into the interior. The armouring 235 on the cable 230 and the cores 231 thereof is inserted through the gap between the sleeves 260A and 260C, so that after the injection moulded part 250 has been integrally formed, the cable 230 is efficiently secured against tensile forces. A total of four sleeves, one for each recess, can be provided, but the preferred solution is with two opposite clamping sleeves, so that during casting, the free receiving recesses additionally prevent twisting of the moulded part 250. An electromagnetic screen 236 is provided as is shown most clearly in FIG. 3. In the example embodiment in FIG. 4 likewise, the injection-moulded material completely fills the cable entry hole 218.

In an embodiment not shown but covered by the following claims, a cable, preferably together with a clamping sleeve, is secured to a number of the radial bores 141 A–D. As the skilled man will see, the plug part according to the invention, comprising a crown-like extension, is suitable for either a coaxial or a radial cable inlet and outlet, and owing to the triple thread the connector can be assembled quickly, with one hand if required.

What is claimed is:

1. A connector for a cable for underground mining, comprising a socket part and a plug part axially insertable into the socket part and having a back portion with a hole for inserting a cable, the plug part being secured to the socket part by a screw cap mounted for rotation on the plug part and screwable on to an external thread on the socket part and being sealed against penetration of moisture and dirt by at least one sealing element, in which the external thread on the socket part and an associated internal thread on the screw cap are multiple threads and a crown part with at least one radial recess for receiving the cable having a cable entry hole on the back of the plug part, and a clamping sleeve seated in one of said radial recesses which sleeve receives said cable.

2. A connector according to claim 1, in which the crown part has a number of receiving recesses offset from one another by 90° and/or open at the edge.

3. A connector according to claim 1, in which the crown part and the plug part are in one piece and preferably in the form of a turned metal part, especially a turned brass part.

4. A connector according to claim 1, in which a screen for increasing the electromagnetic shielding is placed on or between the recesses in the crown part and/or additional mechanical reinforcement of the cable, when inserted coaxially, is obtainable by means of the screen or by radially aligned sleeves (260A, 260C) secured in the recesses.

5. A connector according to claim 1, in which a permanently elastic injection moulding which surrounds or fills the cable, cable entry hole and crown part is integrally formed on the plug part.

6. A connector according to claim 1, in which the external thread on the socket part and the internal thread on the plug part are triple threads.

7. A connector according to claim 1, in which the inner periphery of the screw cap has a peripheral groove for receiving a locking-edge ring or the like for providing the rotatable mounting on the plug part.

8. A connector according to claim 1, in which a gap sufficiently large to allow free running and prevent overscrewing of the screw cap is provided between the internal thread and an annular web of the groove facing the internal thread.

9. A connector according to claim 1, in which in the assembled state, a sealing ring, especially an O-ring, is placed between the end face of the screw cap and an abutment flange for the screw cap on the socket part and is preferably disposed in a groove between the external thread and the abutment flange.

10. A connector according to claim 1 in which said sleeve is connected to said armor or said sheath of said cable.

11. A connector according to claim 5, in which said plug part is formed with a groove for a sealing ring in the wall portion bounding said cable entry hole.

* * * * *